United States Patent [19]

Brass

[11] Patent Number: 5,032,959

[45] Date of Patent: Jul. 16, 1991

[54] INDIRECT LUMINAIRE WITH MIDPOINT ZONED IMAGING REFLECTORS

[75] Inventor: John R. Brass, Novato, Calif.

[73] Assignee: Lighting Research & Development, Inc., Novato, Calif.

[21] Appl. No.: 432,134

[22] Filed: Nov. 6, 1989

[51] Int. Cl.[5] ..... F21V 7/16

[52] U.S. Cl. ..... 362/238; 362/241; 362/297; 362/346; 362/147

[58] Field of Search ..... 362/147, 235, 236, 237, 362/238, 240, 241, 247, 297, 301, 346

[56] References Cited

U.S. PATENT DOCUMENTS

| | | | |
|---|---|---|---|
| 4,344,111 | 8/1982 | Ruud et al. | 362/297 |
| 4,386,392 | 5/1983 | Reibling | 362/301 |
| 4,388,675 | 6/1983 | Lewin | 362/241 |
| 4,760,505 | 7/1988 | Cole, Jr. | 362/241 |
| 4,866,584 | 9/1989 | Plewman | 362/241 |

*Primary Examiner*—Ira S. Lazarus
*Assistant Examiner*—Sue Hagarman
*Attorney, Agent, or Firm*—Hopgood, Calimafde, Kalil, Blaustein & Judlowe

[57] ABSTRACT

The present invention is directed to an indirect luminaire, and to a lighting system using at least two such luminaires. The invention comprises a luminaire in which a linear light source and longitudinally linear reflectors are mounted in parallel inside a housing. The reflectors are located underneath and on each side of the light source and have angled facets which are adopted to reflect light to the sides at an upward angle. In the lighting system of this invention, the reflectors beam light onto the ceiling in the midpoint zone between parallel rows of luminaires to provide highly uniform and efficient lighting.

12 Claims, 5 Drawing Sheets

INDIRECT LUMINAIRE WITH MIDPOINT ZONED IMAGING REFLECTORS

The present invention relates to a luminaire for use in a system of indirect lighting, such as for use in offices or homes, which provides both high efficiency and relatively even and glare-free lighting.

It is well-known that direct lighting may produce unsatisfactory conditions, e.g., glare, uneven lighting or harsh lighting conditions. This is particularly problematic in work environments, such as where computer screens are regularly in use. Consequently, several methods of indirect lighting have been developed to avoid one or more of the problems associated with direct lighting. These systems often include diffusers, refractors, reflectors and other elements to scatter the light or bounce light off ceilings and/or wall surfaces.

One difficulty with common indirect lighting systems is a severe loss in efficiency. Much of the light produced by the light source is absorbed by surfaces prior to reaching the area being illuminated. Another problem is that many such systems are fairly crude, scattering light more or less at random; because of this, the space being lit may be subject to uneven lighting, and the light may, in large part, not go where it will do the most good.

Often indirect lighting fixtures direct most of the available light toward the ceiling directly above the fixture, so that the light bounces down and hits the fixture instead of following a clear path toward the floor. The blocking effect of such fixtures is often a major cause of lighting inefficiency. This effect is especially pronounced when a wide fixture is used, as is often the case in common indirect lighting systems.

U.S. Pat. No. 4,760,505 describes an indirect lighting fixture having specular side reflectors to direct light to the sides to achieve improved ceiling brightness uniformity and high efficiency. However, there are no reflectors directly under the lamps to redirect the light striking the bottom of the fixture, and although the side reflectors are designed to spread the light across a relatively wide ceiling area, they are not designed to maximize the strength of light directed to the ceiling midpoint between rows of luminaires. As with other prior art luminaires, this design is not based on a coherent system concept directed to optimizing ceiling brightness uniformity. With prior art luminaires, no system midpoint beam was defined.

Another disadvantage of the prior art luminaire referred to above is that the fluorescent lamp ballast is mounted at one end of the luminaire. This increases the length of each luminaire and makes it impossible to construct luminaires that are exact building module lengths, e.g., 4 or 8 feet.

SUMMARY OF THE INVENTION

The present invention is directed to an indirect luminaire, for use beneath a reflective ceiling, having a substantially linear light source parallel to the ceiling and reflector means oriented substantially parallel to said light source, said reflector means located underneath and to either side of said light source and having facets angled to direct light upwardly and sidewardly so that most of the reflected light is not directed toward the ceiling immediately above the luminaire but is directed toward areas of the ceiling on either side thereof. The luminaire is designed for use with one or more other such luminaires located parallel thereto, the luminaires being spaced apart, and having reflector facets, such that the light directed by the reflectors toward the ceiling area midway between the parallel luminaires is maximized.

It is an object of the present invention to provide a luminaire which produces indirect light relatively efficiently while providing improved ceiling brightness uniformity.

It is also an object of this invention to provide an indirect lighting system wherein the ceiling brightness is maximized midway between parallel rows of lights. This provides improved ceiling brightness uniformity.

Another object of this invention is to provide a light fixture having reflectors which efficiently throw the majority of the light produced by the light source at an upward angle to both sides of the fixture.

It is a further object of this invention to provide a compact lighting fixture which beams light onto an area of the ceiling surface much wider than the width of the fixture.

It is still another object of this invention to provide compact fluorescent luminaires having lengths corresponding exactly to building module dimensions (e.g., 4 or 8 feet) so that supporting stems and canopies (or cable fillings) will consistently fall in the same relationship to ceiling system geometry.

Other objects and advantages of the present invention will be apparent to those skilled in the art from the following detailed description and from the accompanying drawings.

DETAILED DESCRIPTION OF PREFERRED EMBODIMENTS

Figure 1:
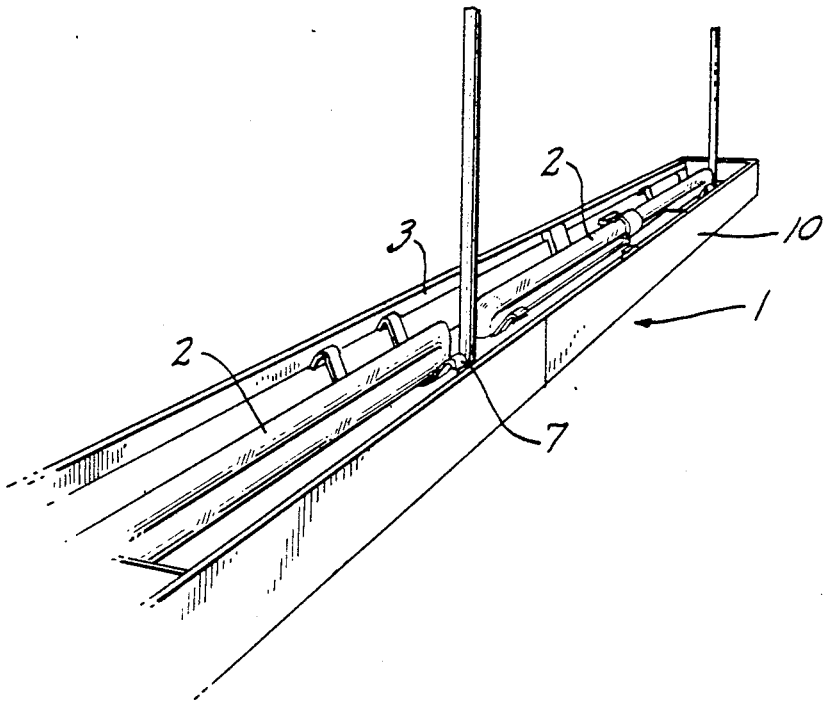
FIG. 1 is a perspective view of one embodiment of luminaires according to the present invention.
Figure 1A:
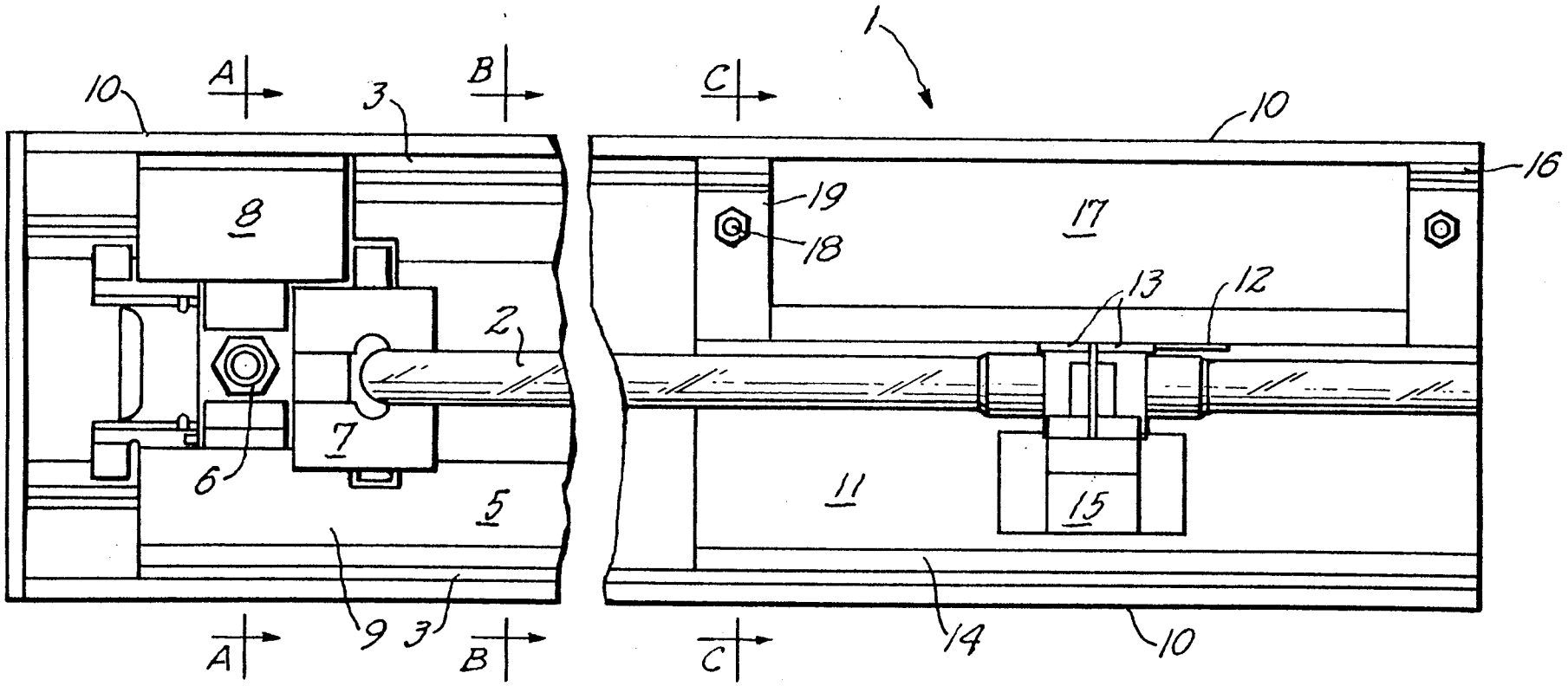
FIG. 1A is a plan view of a luminaire according to the present invention.

An example of one embodiment of the present invention is illustrated in FIGS. 1 and 1A. The luminaire 1 contains a fluorescent lamp 2 mounted onto the housing 10 via a lamp-end cradle 7 at one end and a lampholder 13 and lampholder bracket 12 at the other end. Associated with the lampholder 13 is a lampholder cover 15. A ballast 17 is attached via a ballast mounting stud 18 and ballast fastener set 19. Near the lamp-end cradle 7 is an electrical conduit 6 and wiring cover 8, which contain the necessary electrical wiring. The main reflectors 3 and center reflector 14 are mounted parallel to the lamp 2. A fill reflector 9 is located near the conduit 6 to improve lighting efficiency; a small fill reflector 16 is used at the other end of the luminaire 1. The center panel 11 supports a bottom diffusing reflector pan 5.

Figure 2:
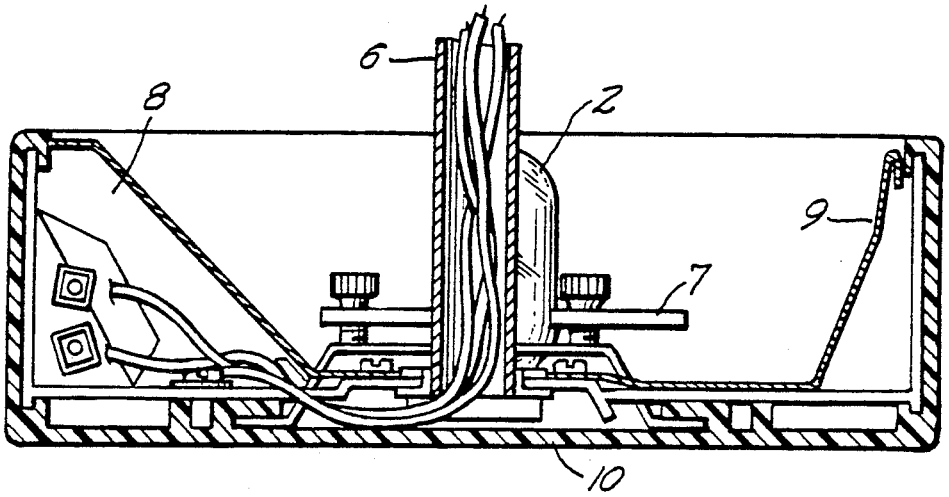
FIG. 2 is a cross-sectional elevation of the luminaire in FIG. 1A viewed along line A—A.
Figure 3:
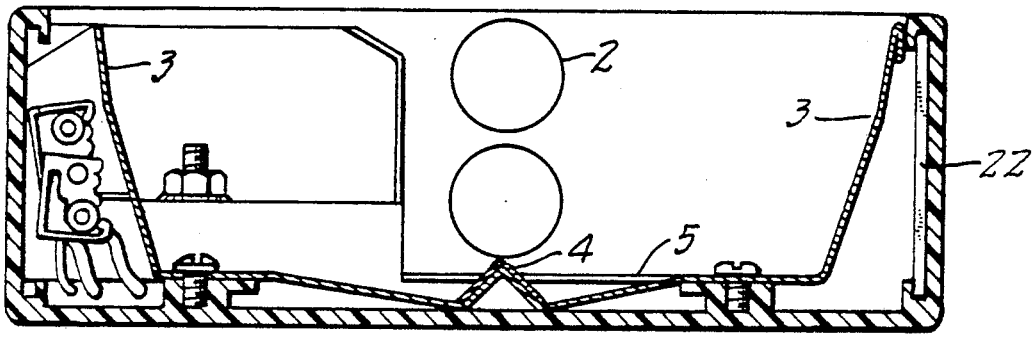
FIG. 3 is a cross-sectional elevation of the luminaire in FIG. 1A viewed along line B—B.
Figure 4:
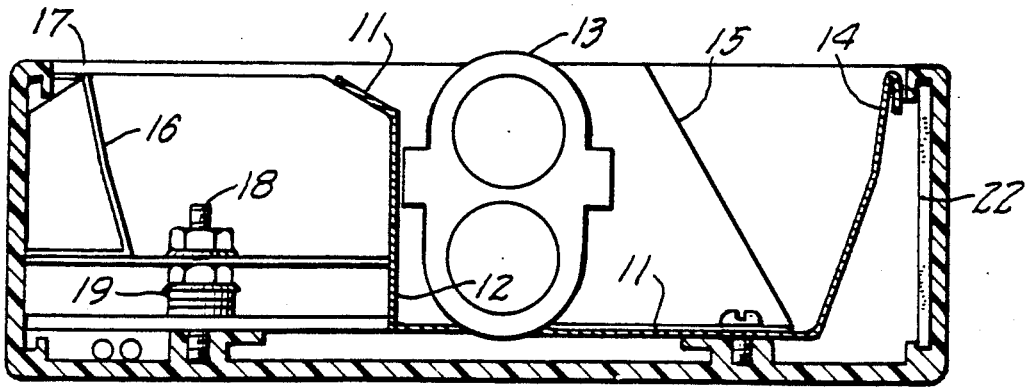
FIG. 4 is a cross-sectional elevation of the luminaire in FIG. 1A viewed along line C—C.

FIGS. 2–4 further illustrate the embodiment shown in FIG. 1A. In these cross-sectional views, the V-shaped reflector 4 is visible. A counterweight 22 is also shown.

Figure 5:
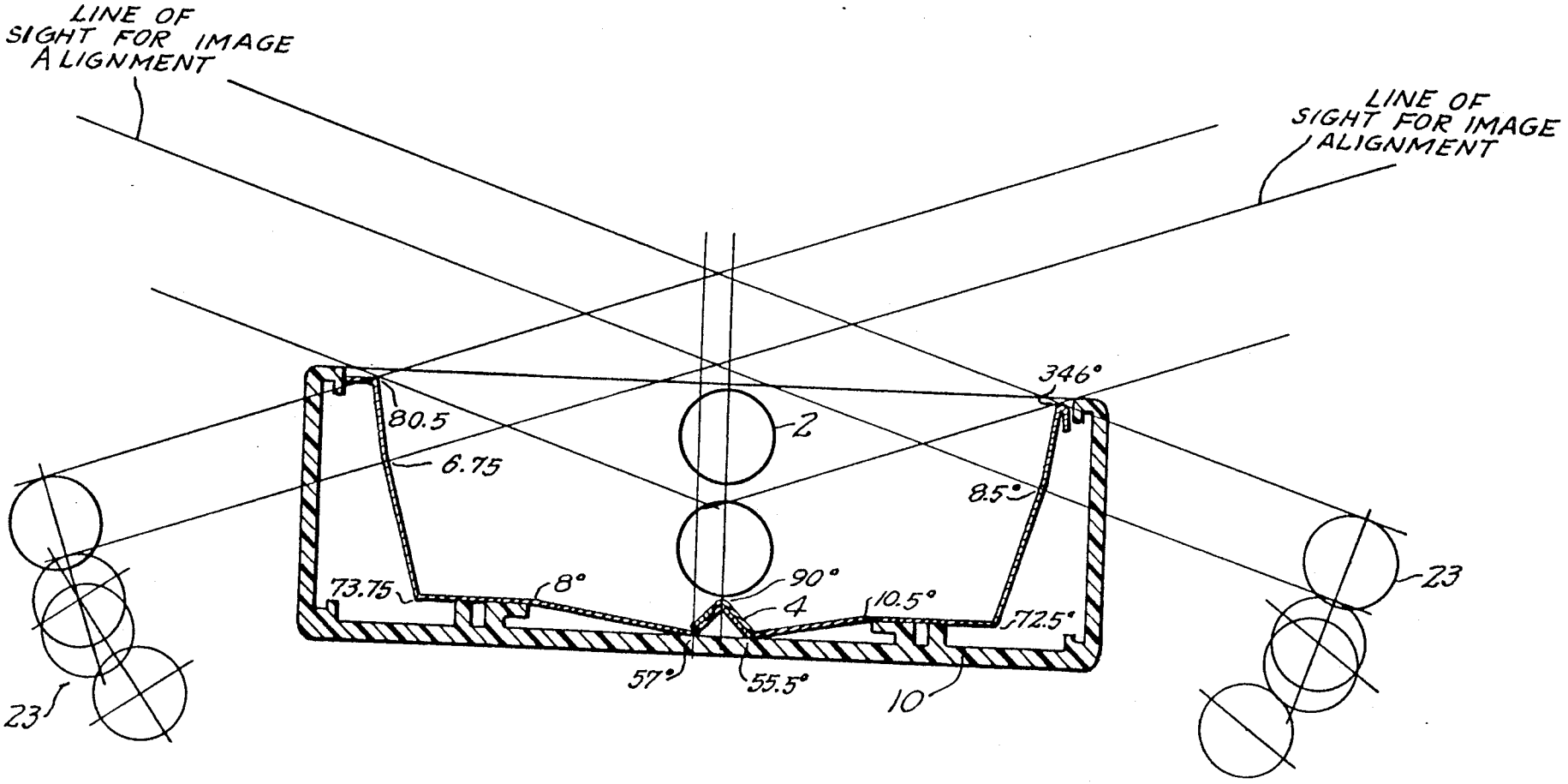
FIG. 5 and FIG. 6 are elevations of a cross-section of a center portion of luminaires according to the present invention; these figures each illustrate a different set of reflector angles.
Figure 6:
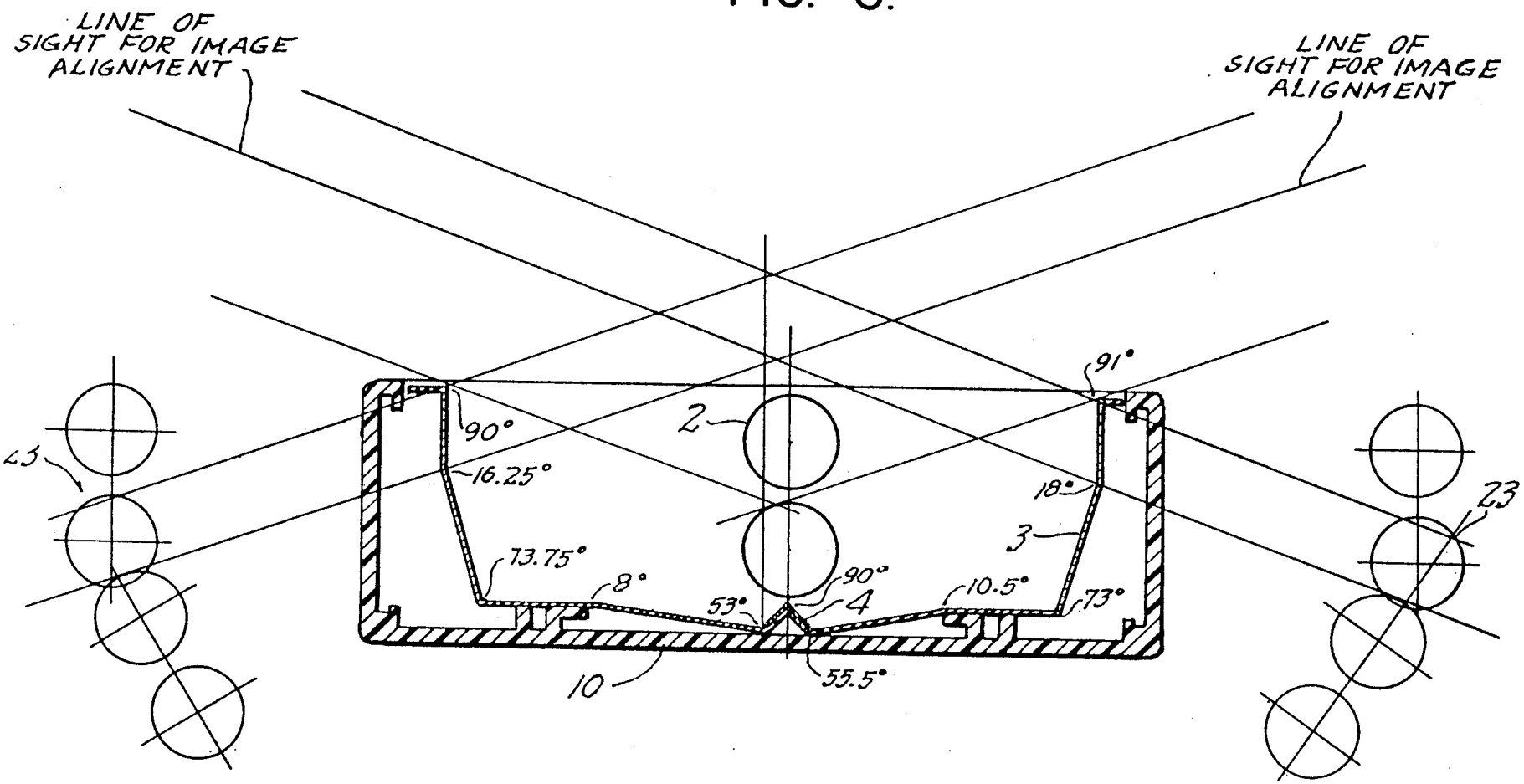

FIGS. 5 and 6 illustrate two embodiments for use in a system having parallel rows of luminaires spaced apart a distance six times the drop distance (the distance between the ceiling and the top of each luminaire). Reflector 3 is angled to beam the reflected light at an angle of about 18.4 degrees above horizontal. The dashed lines shown in FIGS. 5 and 6 indicate the midpoint zone of light created by the lamp images 23—a zone directed toward the ceiling zone midway between the rows of luminaires. The reflector geometry is determined by the placement of lamp images 23 in each side reflector 3 so that these images fall in this midpoint zone, as illustrated in FIG. 6. This image zoning technique insures that the midpoint zone will be filled images, which maximizes the strength of the midpoint beam. By way of contrast, traditional ray tracing methods only confirm the direction of a few light rays. The embodiment shown in FIG. 5 produces a slightly higher overall efficiency than that of FIG. 6, but nevertheless, the embodiment shown in FIG. 6 is preferred because it more effectively concentrates the light in the midpoint zone.

The lamp 2 illustrated in FIGS. 1–6 is a biaxial fluorescent lamp unit. The twin tubes of this lamp 2 are oriented vertically to minimize upwardly directed light and maximize sideward light distribution. These units are useful in producing a compact luminaire 1 because of the small diameter of the bulbs.

Figure 7:
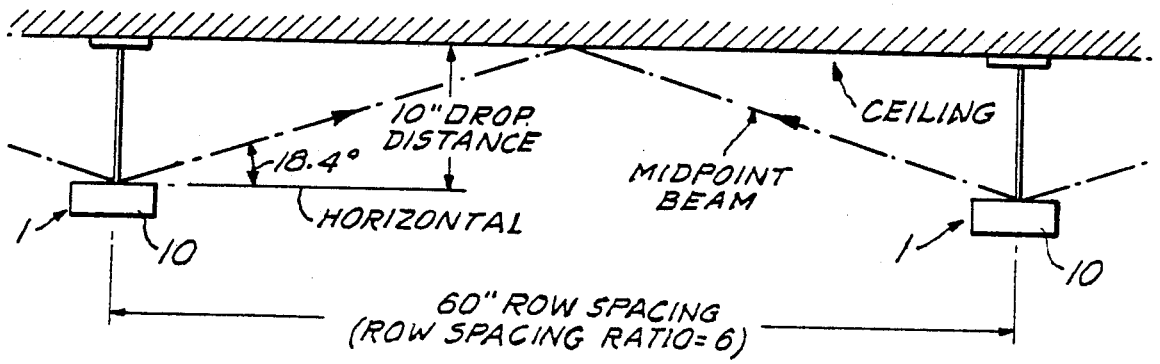
FIG. 7 is an elevation of a lighting system according to the present invention.

FIG. 7 illustrates one example of a lighting system according to the present invention in which the row spacing ratio is six to one. The midpoint beams are illustrated by dashed lines emanating from parallel rows of luminaires 1 at an angle of 18.4 degrees above the horizontal.

An important aspect of the present invention is the use of reflectors both underneath and to the sides of the light source, said reflectors having facets angled so that the light striking the reflectors is beamed to the sides of the light source at an upward angle.

The angle at which the light is beamed off the reflectors is determined by the facet angles, which are fixed in accordance with the requirements of the system in which the luminaire is to be used. Generally, it is contemplated that two or more parallel rows of luminaires mounted horizontally beneath a reflective ceiling will be used together. The distance from the top of the light source to the ceiling under which the light is positioned, together with the distance between rows of luminaires, determines the desired angle at which the light should be beamed off the reflectors. The distance between luminaire rows is measured from the center of one luminaire to the center of the other.

It is most desirable to beam the reflected light to the ceiling area midway between adjacent parallel luminaires. The efficient illumination of this midpoint zone produces improved ceiling brightness uniformity and promotes the efficient indirect lighting of the room.

Various embodiments of the lighting system of the present invention are intended to achieve a ceiling brightness ratio of less than about four to one, preferably between about four and about two. Ratios less than two are, of course, desirable, but are impractical because uneconomically close row spacing would be needed and because improving light uniformity beyond a ratio of two is not sufficiently important (visually) to justify the added expense.

To achieve these goals, it should first be determined what will be the distances between luminaire rows and between the ceiling and the tops of the luminaires. The ratio of these distances determines the angle at which the reflectors must beam the light to maximize the beam in the midpoint zone. As a practical matter, the predetermined ratio of the system row spacing to the drop distance should be in the range of about four to one to about nine to one. Preferably, the ratio is six to one or greater. Typically, the drop distance of the luminaires of this invention is no less than about 8–9 inches.

After the design criteria for row spacing ratio and midpoint beam angle have been determined, it is desirable to meet these criteria in a luminaire that is as compact as possible, i.e. as narrow and shallow as possible. Relatively narrow luminaires provide improved illumination efficiency because they block relatively less ceiling-reflected light, whereas shallow luminaires provide increased headroom for those below. The importance of these advantages increases as room ceiling heights, and thus allowable drop distances, are reduced. At the not untypical drop distance of 8–10 inches, the performance advantages of compact luminaires according to the present invention is most significant.

Once the row spacing ratio is determined, the reflector facets can be made to beam images of the light source to the midpoint zone by setting the facets at appropriate angles. For example, if the ratio is six to one the facets must be set so that the reflected light will be beamed to the side at an upward angle of about 18–19 degrees above the horizontal, preferably about 18.4 degrees.

The reflectors used in the present invention are highly specular, or mirror-like, having an optical coating to permit well over 90% of the light striking the reflector to be reflected, not absorbed. Typically, these reflectors comprise 94% reflectance mirrors. It will be understood that any suitable reflector material may be used which will reflect an image of the light source with an efficiency greater than 80%. Of course, the greater the percentage of light reflected, the better will be the overall efficiency of the luminaire. With 94% reflectors in the luminaires of the present invention, it is possible to produce an overall efficiency in the area of 85%, which is quite high for indirect lighting systems. It should be noted, however, that in the system of the present invention the concentration of the light in the midpoint zone is just as important as overall efficiency, so that it is generally better to angle the facets so that the midpoint beam will be maximized even if the overall efficiency of the luminaire may be reduced slightly thereby.

The present invention combines side reflectors with one or more bottom reflectors. A reflector of inverted V-configuration located directly beneath the light source directs light to the sides; the side reflectors are angled to reflect light at the optimum angle, as discussed above. The reflectors are designed to concentrate the light in the midpoint zone rather than to spread the reflected light over an indeterminate expanse of the ceiling. It has been found that by so concentrating the light in this ceiling area, which is usually the most weakly illuminated, greater ceiling brightness uniformity is achieved and the blocking effect of the fixtures is minimized.

A large, or deep, inverted V-shaped reflector would send the maximum amount of downward light to the sides. However, this would require a deeper and wider fixture which could unfavorably impinge on headroom and would increase light blocking by the luminaire itself. Consequently, it is preferred to use a diffusing reflector pan on the bottom of the fixture in conjunction with a small V-shaped reflector. This pan is a horizontal element which softens the light reflected upward. A preferred reflector pan comprises a large white panel which, although not specular, absorbs relatively little incident light. By combining the pan and the V-shaped reflector, a shallow, compact fixture which efficiently illuminates the midpoint zone is achievable.

In another embodiment, the small V-shaped reflector is used with specular or semi-specular bottom sloping reflectors which slope gently upward from the Vee to the side reflectors, as shown in FIGS. 5 and 6. This arrangement also permits the unit to be compact and to efficiently illuminate the midpoint zone.

The light source of this invention should be linear; the source may be one light-producing element or an array thereof. It is preferred to use linear fluorescent lights, either singly or in combination. More preferably, a biaxial lamp is used, with its twin tubes oriented vertically to maximize the amount of light reflected sideways and minimize the amount of light striking the ceiling over the source.

The present invention is not limited to the illustrated embodiments, but encompasses every device consistent with the foregoing description which falls within the scope of the following claims.

I claim:

1. A linear indirect luminaire, for use beneath a reflective ceiling, comprising:

a housing;

a linear light source mounted inside said housing;

a first reflector means mounted inside said housing beneath and parallel to said light source, said means having specular angled facets adapted to direct light traveling downward from said source at an upward angle away from the portion of the ceiling directly above said luminaire; and a second reflector means mounted inside said housing on either side of and parallel to said light source, said second reflector means having specular facets adaptable tube angled to reflect substantially a majority of light from said light source at an upward angle away from said portion of the ceiling to those portions of the ceiling extending from both sides of said housing.

2. A luminaire according to claim 1 wherein said light source comprises a linear fluorescent light bulb.

3. A luminaire according to claim 1 wherein said light source comprises a biaxial linear fluorescent unit mounted so that one tube is directly above the other.

4. The luminaire according to claim 1 wherein first reflector means comprises a longitudinally linear specular reflector having an inverted Vee cross-sectional configuration located directly underneath said light source, said Vee approximately forming a right angle.

5. A luminaire according to claim 4 wherein said first reflector means further comprises a planar reflector extending from said inverted Vee toward said second reflector means.

6. A luminaire according to claim 4 wherein said first reflector means further comprises a specular or semi-specular sloping reflector element sloping upwardly from said inverted Vee to said second reflector means.

7. A luminaire according to claim 1 wherein said second reflector means comprises one or more longitudinally linear, vertically faceted, specular reflectors.

8. An indirect lighting system, for use beneath a reflective ceiling, comprising:

a first luminaire according to claim 1; and, a second luminaire according to claim 1, said luminaires mounted substantially parallel to each other, said first and second reflector means of each said luminaire having said facets angled to maximize the light reflected onto said ceiling in a midpoint zone located midway between said luminaires.

9. A lighting system according to claim 8 adapted to produce a ceiling brightness ratio of about four to one, or less.

10. A lighting system according to claim 8 wherein said substantially parallel luminaires are spaced apart a horizontal distance of from about four to about nine times the distance between said ceiling and the top of said light source, said horizontal distance being defined as the distance from center to center.

11. A lighting system according to claim 10 wherein said luminaires are spaced apart a distance six times the distance from the ceiling to the top of said light source, and said facets are angled to reflect light sidewardly at an upward angle of about 18 to about 19 degrees above horizontal.

12. A linear indirect luminaire according to claim 1 wherein said housing comprises dimensions of building modules for arranging locations for supporting stems and canopies or cable fillings to coincide with said building modules.

* * * * *